US009517871B2

(12) United States Patent
Enko et al.

(10) Patent No.: US 9,517,871 B2
(45) Date of Patent: Dec. 13, 2016

(54) CHILD-RESISTANT AIR FRESHENER CONTAINER

(71) Applicant: The Yankee Candle Company, Inc., South Deerfield, MA (US)

(72) Inventors: Frederick A. Enko, Westfield, MA (US); Cheriyan B. Thomas, Farmington, CT (US)

(73) Assignee: The Yankee Candle Company, Inc., South Deerfield, MA (US)

( * ) Notice: Subject to any disclaimer, the term of this patent is extended or adjusted under 35 U.S.C. 154(b) by 23 days.

(21) Appl. No.: 14/480,567

(22) Filed: Sep. 8, 2014

(65) Prior Publication Data

US 2016/0068318 A1 Mar. 10, 2016

(51) Int. Cl.
*B67D 3/00* (2006.01)
*B65D 65/42* (2006.01)
*B65D 65/40* (2006.01)

(52) U.S. Cl.
CPC ..... *B65D 65/42* (2013.01); *B65D 65/403* (2013.01)

(58) Field of Classification Search
CPC ..... B65D 51/20; B65D 55/145; B65D 1/0246; B65D 41/32; B65D 41/34; B65D 51/1633; B65D 51/1688; B65D 51/18; B65D 55/02; B65D 83/06; B65D 2251/0015; B65D 41/0471; B65D 50/043; B65D 47/32; Y10T 70/558; A47G 19/2255; A47G 19/2272; A61J 1/03
USPC ..... 222/528–532; 215/283; 70/167
See application file for complete search history.

(56) References Cited

U.S. PATENT DOCUMENTS

| | | | | |
|---|---|---|---|---|
| 7,074,443 | B2 * | 7/2006 | Thomas | B65D 51/1644 220/203.01 |
| 7,624,889 | B2 * | 12/2009 | Tharp | B60K 15/0406 220/210 |
| 8,333,289 | B2 * | 12/2012 | Lopez | B65D 25/36 206/205 |
| 2008/0257849 | A1 * | 10/2008 | Farrar | B65D 39/08 215/222 |
| 2008/0302752 | A1 * | 12/2008 | Farrar | B65D 45/345 215/200 |
| 2009/0230079 | A1 * | 9/2009 | Smolko | B65D 41/0442 215/261 |
| 2014/0360970 | A1 * | 12/2014 | Chen | B65D 41/0471 215/217 |

(Continued)

FOREIGN PATENT DOCUMENTS

| | | | |
|---|---|---|---|
| CN | 103315509 | A | 9/2013 |
| WO | 2014194684 | A1 | 12/2014 |

*Primary Examiner* — Shawn M Braden
(74) *Attorney, Agent, or Firm* — Christina DeAngelis

(57) ABSTRACT

A child-resistant container including a bottle having a first locking member associated therewith, a bottle cap for selectively engaging the bottle, the bottle cap including a second locking member for selectively engaging the first locking member, and a removable gasket positioned and located within the bottle cap for allowing the bottle cap to partially engage the bottle but preventing the first locking member from engaging the second locking member so long as the gasket is positioned within the bottle cap. Removal of the gasket from the bottle cap allows the bottle cap to be fully engaged with the bottle and allows the first locking member to engage the second locking member thereby activating the child-resistant locking mechanism.

18 Claims, 3 Drawing Sheets

(56) References Cited

U.S. PATENT DOCUMENTS

2015/0210450 A1* 7/2015 Mercado ..... B65D 51/228
220/258.2

* cited by examiner

CHILD-RESISTANT AIR FRESHENER CONTAINER

BACKGROUND OF INVENTION

The present invention relates to a child-resistant air freshener container for containing scented odor-neutralizing beads or other fragrance materials that absorb surrounding odors and diffuse a pleasant fragrance into a surrounding environment and, more specifically, to a bottle and cap locking mechanism that includes a gasket for allowing a person to initially open and unseal the freshener bottle and then fully lock the cap onto the bottle to prevent a child from being able to access the odor-neutralizing beads contained therein once the seal is removed.

Air freshener containers that contain odor-neutralizing beads are often used in laundry rooms, bathrooms, and other rooms and locations throughout a home, office and other locations where a candle may be inconvenient or where an air freshener device is preferred. Some individuals prefer to use air freshener containers utilizing odor-neutralizing beads as compared to other air freshener devices widely known and used such as candles, reed diffusers, or plug-in air freshening devices.

Air freshener containers utilizing odor-neutralizing beads typically include a threaded bottle or jar for engaging corresponding threads on a bottle cap or closure lid and a removable seal covering the beads and fragrance oils typically housed within the bottle. The bottle cap is typically threadedly engaged to the bottle over the removable seal when packaged for sale and requires, the user to remove the cap and then remove the seal before use. A typical air freshener container includes a bottle cap threaded on its inner wall for engaging the corresponding threads on the outer wall of the neck of the bottle. The bottle cap includes a plurality of vent holes for allowing the scent of the odor-neutralizing beads to emanate from the bottle. The removable seal helps to prevent the odor-neutralizing beads within the bottle from drying out and losing their fragrance before use, and it likewise further prevents the fragrant oils contained within the bottle from leaking before use. By removing the seal, the odor-neutralizing beads begin to diffuse the pleasant fragrance to the surrounding environment. As a result, before a typical air freshener fragrance container can be activated, the cap or closure member must be removed and re-engaged with the fragrance bottle after the seal has been removed.

Many child safety locks exist and are known in the art for securely locking a cap to a bottle so as to prevent children from accessing the contents of the container. Once the child safety lock is engaged, it is extremely difficult to reopen the container and, in some mechanisms, it requires breaking the mechanism to gain access to the contents of the container. For example, in some known air freshener fragrance jars, the stoplock mechanism is associated with both the fragrance bottle neck and the cap and when the cap is fully engaged with the bottle neck, the lock mechanism prevents the cap from being again removed to access the contents of the bottle or the seal if the seal has not been removed. This is not desirable. Also, fully engaging the child safety lock before removing the removable seal renders the air freshener container unusable unless one is able to poke holes through the seal via the vent holes in the cap. Even if this is possible, the full fragrance capacity of the container cannot be activated since only a small portion of the removable seal has been removed via the poking of holes therethrough to allow the fragrance to pass therethrough.

A child lock mechanism is therefore desired that still allows the bottle cap to be securely locked to the bottle with the removable seal in place but without engaging the child safety lock, then allows the cap to be removed to provide access to the removable seal for removal thereof, and then further allows the cap to be re-engaged to the bottle neck so as to engage the child safety lock. This solution should be simply designed, inexpensive, and easily manufactured.

SUMMARY OF INVENTION

The present invention relates to an air freshener container and, more particularly, to a child-resistant air freshener container which allows a user to securely engage the bottle cap to the bottle neck without engaging the child safety lock mechanism associated therewith until such time a removable seal is removed and the air freshener container is activated. The present air freshener container includes a bottle with a threaded neck, a bottle cap with corresponding threads for selective mating with the threaded neck of the bottle, and a removable gasket that may be placed between the bottle and cap so as to prevent the bottle cap from being fully locked to the bottle in its child lock safety mode until desired.

When a user purchases the present air freshener container or otherwise obtains the present container prior to use, the removable gasket is snugly positioned within the bottle cap such that when the bottle cap is threadedly engaged to the bottle neck, the gasket will be positioned between the first and second locking members associated with the child safety lock mechanism thereby preventing the first and second locking members from engaging each other. The child safety lock member, in one embodiment, includes a latching block or tab (a second locking member) located on the inner wall of the bottle cap. The latching block includes a tapered ramp or inclined surface and a rear surface which is positioned and located for mating with a separate first locking member located on the threaded neck of the bottle. In one embodiment, the first locking member is a projection having a tapered ramp or inclined surface and a rear surface. The latching block (second locking member) and the projection (first locking member) are respectively positioned and located such that when the bottle cap is fully threaded onto the bottle, the tapered ramp of the latching block will slide over the tapered ramp of the projection and the rear surface of the latching block will rest behind and adjacent to the rear surface of the projection. Once the latching block is positioned behind the rear surface of the projection, the rear surfaces of the latching block and projection are positioned in abutting relationship to each other and the cap will be prevented from being rotated in the opposite direction to remove the same. As such, the rear surface of the latching block and the rear surface of the projection function as a stop mechanism to prevent removal of the cap from the bottle.

When the gasket member is properly positioned within the bottle cap, the gasket prevents the bottle cap from being completely threaded onto the bottle thereby preventing the two child safety locking members from engaging each other and thereby preventing the child safety lock mechanism from being activated. The latching block and projection are positioned and located such that the bottle cap can be securely engaged with the bottle short of engaging the child safety lock mechanism. This arrangement allows the bottle cap to be partially threaded but securely positioned on the bottle with the removable seal in place for packaging and selling purposes, and further allows a user to easily remove the bottle cap to further remove the seal when the air freshener fragrance container is ready to be activated for use.

Once the seal is removed from the top of the bottle and the gasket is removed from the bottle cap, the cap can now be re-engaged with the bottle neck and the cap can now be fully threaded such that the second locking member will engage the first locking member and activate the child safety lock mechanism.

It is recognized and anticipated that other first and second child safety locking members can likewise be utilized in conjunction with the present gasket member to accomplish the above stated goal.

DESCRIPTION OF THE DRAWINGS

In the accompanying drawings, which form a part of the specification and are to be read in conjunction therewith, in which like reference numerals are used to indicate like or similar parts in the various views.

DETAILED DESCRIPTION OF THE INVENTION

From the foregoing, it will be seen that the present invention is one well adapted to attain all the goals and objectives hereinabove set forth together with other advantages which are obvious and which are inherent to the structure. It will be understood that certain features and sub combinations are of utility and may be employed without reference to other features and sub combinations. This is contemplated by and is within the scope of the claims. Since many possible embodiments of the present invention may be made without departing from the spirit and scope of the present invention, it is also to be understood that all matters herein set forth or shown in the accompanying drawings are to be interpreted as illustrative only and not limiting.

Figure 1:
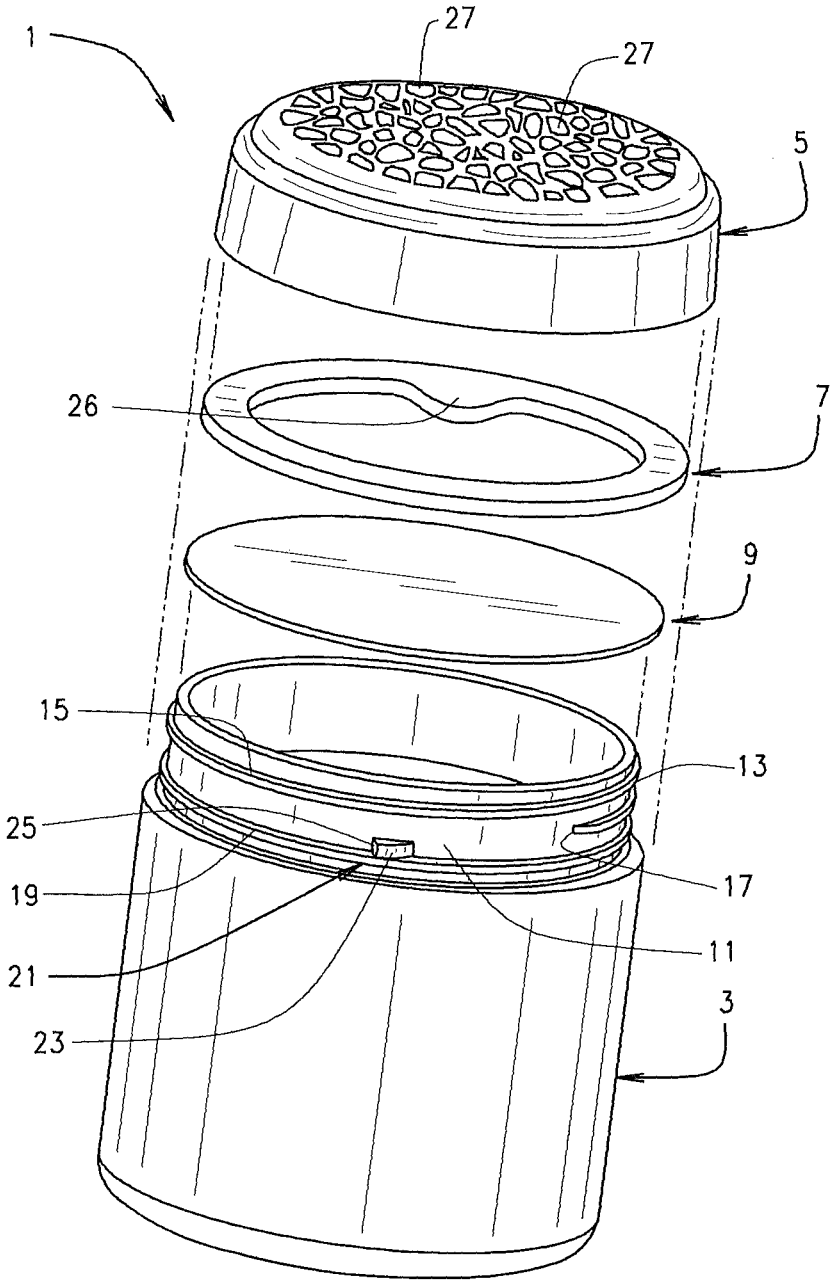
FIG. 1 is an exploded perspective view of an air freshener container constructed according to the teachings of one embodiment of the present invention.
Figure 2:
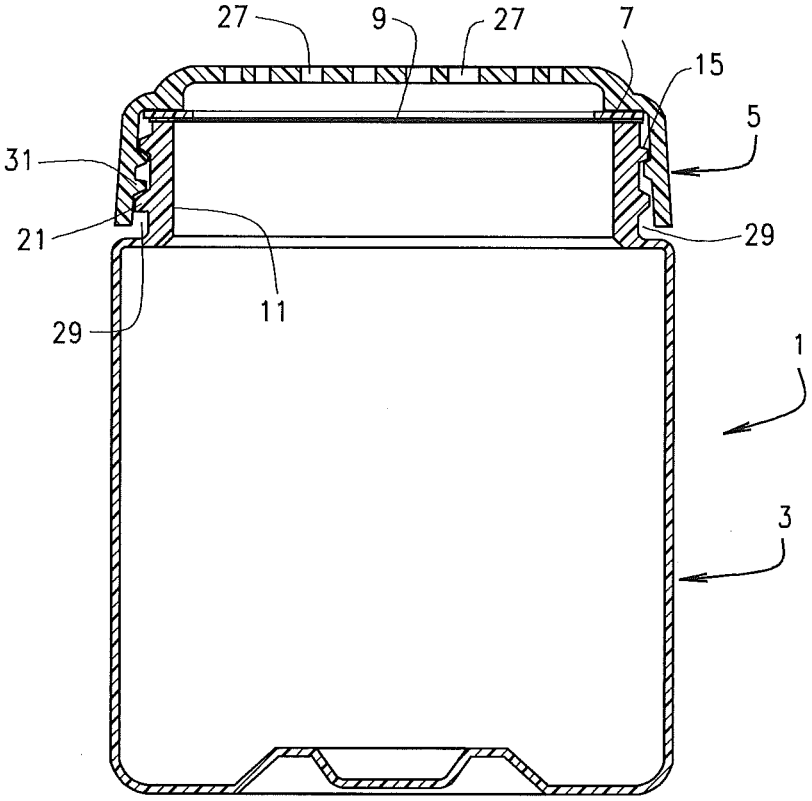
FIG. 2 is a cross-sectional view of the air freshener container of FIG. 1.

FIG. 1 illustrates an exploded perspective view of one embodiment of the present air freshener container while FIG. 2 is a cross-sectional view thereof. Air freshener container 1 includes a bottle 3 for containing odor-neutralizing beads and associated fragrant oils (not illustrated) as known in the art, or any other fragrance material, a bottle cap 5, a gasket member 7 and a removable seal member 9. The bottle cap 5 may be selectively mated with bottle 3 via corresponding threads in a manner described in greater detail below and generally known in the art. The gasket member 7 is preferably used in order to prevent bottle cap 5 from fully locking with the bottle 3 and engaging the child safety lock mechanism until a user has decided to do so as more fully explained hereinbelow. A removable seal 9 is preferably attached to the opening of bottle 3 when the present air freshener container 1 is purchased or otherwise first obtained to protect the contents of the container and to prevent the fragrance beads contained within bottle 3 from emanating their fragrance before a user is ready to activate the same. Removable seal 9 may further act to prevent the fragrant oils or other materials contained within bottle 3 from spilling.

Bottle 3 includes a neck portion 11 for mating with bottle cap 5. The neck portion 11 includes threads 13 having an upper thread portion 15 and a lower thread portion 17. As one skilled in the art can recognize, when bottle cap 5 is threadedly engaged to bottle 3, upper thread portion 15 first receives the corresponding threads associated with the bottle cap 5, and as the bottle cap 5 is threaded downwardly onto the bottle neck portion 11, the lower thread portion 17 further receives the corresponding threads of bottle cap 5. A sealing ring 19 located below the threads 13 lies adjacent to the first locking member of the child safety lock mechanism, projection 21. Projection 21 is made up of a tapered ramp portion or inclined surface 23 and a rear stop surface 25, both of which are integral to projection 21. Projection 21 and the manner by which it will fully lock bottle cap 5 to bottle 3 will be discussed in greater detail below. Threads 13, sealing ring 19 and projection 21, as well as the components that make them up, are preferably integrally formed with bottle neck 11.

Figure 3:
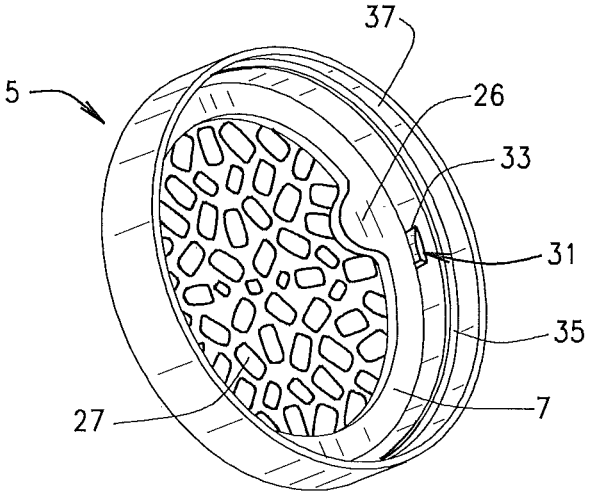
FIG. 3 is a perspective view of the bottle cap illustrated in FIGS. 1 and 2 showing the positioning of the gasket member therewithin.
Figure 4:
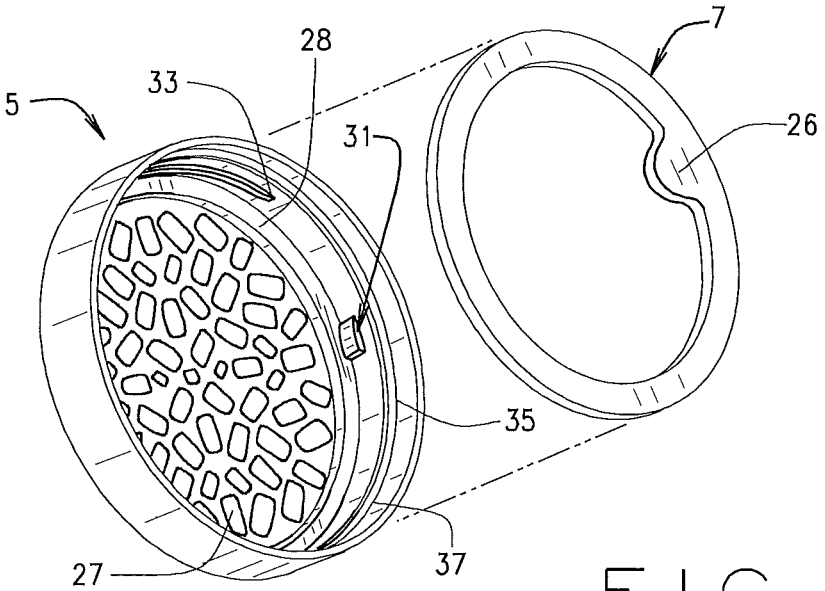
FIG. 4 is an exploded perspective view of the bottle cap and gasket member of FIG. 3.
Figure 5:
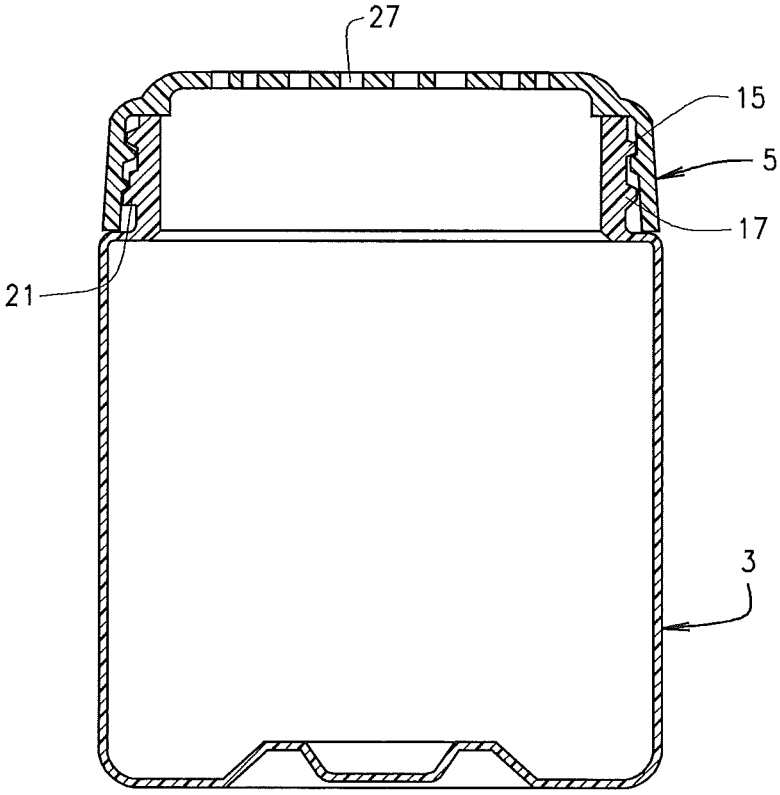
FIG. 5 is a cross-sectional view of the present air freshener container of FIGS. 1 and 2 with the gasket member removed and the bottle cap fully engaged with the bottle.

Gasket member 7 includes a tab 26 that projects inwardly that functions to help a user remove the gasket from within bottle cap 3 when a user is ready to activate the contents of the container and engage the child safety locking mechanism by fully engaging the bottle cap 5 with bottle 3 as illustrated in FIGS. 3-5. In the illustrated embodiment, gasket 7 and tab 26 are integrally formed. Gasket 7 may be a circular ring that is sized and shaped to fit snugly within the bottle cap 5 as illustrated in FIG. 3. The gasket 7 rests upon a shoulder or ledge 28 within the bottle cap 5 (FIG. 4) such that when the cap 5 is engaged with the bottle 3, the gasket 7 will eventually rest in close proximity to the removable seal 9 and is of sufficient thickness that it prevents the cap 5 from being fully threaded onto the bottle neck 11 thus preventing the projection 21 from engaging a latching block or tap 31 (FIGS. 3 and 4) located on the bottle cap 5 as will be hereinafter further explained.

Bottle cap 5 includes at least one and preferably a plurality of vent holes 27 for allowing odor-neutralizing beads, or other fragrance materials, within bottle 3 to diffuse the fragrance scent in a desired environment after seal 9 has been removed. Vent holes 27 can take on a variety of different shapes. Also, there can be any number of vent holes 27 depending upon the fragrance material and the particular application. In any embodiment, however, vent holes 27 should be sized and shaped to sufficiently allow the fragrance associated with the odor-neutralizing beads or other fragrance material to be released therefrom.

When a user purchases or otherwise first obtains the air freshener container 1, gasket 7 will be properly positioned within the bottle cap 5, preventing bottle cap 5 from being fully threaded onto the bottle neck 11 as illustrated in FIG. 2. FIG. 3 illustrates gasket member 7 positioned within the bottle cap 5 and resting upon shoulder 28. As illustrated in FIG. 2, gasket 7 prevents the bottle cap 5 from being fully threaded onto bottle neck 11, thus forming a gap 29 around the circumference of the neck portion 11 between neck portion 11 and bottle cap 5. The gasket 7 and the gap 29 prevent a second locking member, latching block 31 (FIG. 3), also having an inclined or tapered ramp or surface 33 (FIG. 3), from coming into contact with projection 21. When gasket 7 is positioned within the bottle cap 5, an inner thread 35 (FIG. 3) located on the inner wall 37 of bottle cap 5 will be received by the upper bottle thread portion 15 (FIG. 2). When a user rotates bottle cap 5 to threadedly engage the corresponding threads on bottle neck 11, bottle cap 5 will move downwardly onto bottle neck 11 with the inner thread 35 subsequently being received by lower bottle thread portion 17. Because gasket 3 creates gap 29 (FIG. 2), latching block 31 (FIGS. 2 and 3) located in front of the inner thread 35 (FIG. 3) will not reach projection 21 (FIGS. 1 and 2), where it would otherwise ride over projection 21 to fully lock bottle cap 5 to bottle body 3. In FIG. 2, the partial engagement of the cap 5 with the bottle neck 11 is illustrated in cross-sectional form where latching block 31 is viewed as being positioned and located prior to engaging the projection 21. The first and second locking members, projection 21 and latching block 31 or vice versa, work together to form the child safety locking mechanism and to fully engage the same when gasket member 7 is removed.

Once the bottle cap 5 is removed from bottle 3, the gasket member 7 may be easily removed from within bottle cap 5 by pulling on tab 26. Tab 26 may be of any size and shape sufficient for allowing a user to easily grab and pull the same. Gasket 7 is preferably removed when a user is ready to activate the air freshener container 1 and has removed and discarded removable seal 9. After gasket 7 is removed, it also may be discarded. With gasket 7 removed, the additional rotation of bottle cap 5 on bottle neck 11 will allow the inclined surface 33 of latching block 31 to slide along and over the inclined surface 23 of projection 21. Once the latching block 31 clears the projection 21, the rear surface 25 of projection 21 will lie adjacent the rear surface of the latching block 31 thereby preventing reverse rotation of the bottle cap 5 on the bottle neck portion 11. In essence, the respective end portions of the projection 21 and latching block 31 abut each other once they pass each other during rotation of the cap 5 on the bottle neck portion 11 thereby activating the child safety lock mechanism and preventing a user from removing the cap 5 from bottle 3 without breaking either projection 21 or latching block 31. FIG. 5 shows a cross-sectional view of the present container 1 in a fully locked position with gasket 7 removed. As illustrated, latching block 31 has been rotated up and over projection 21 and sits behind projection 21 in FIG. 5.

While the present invention described above identifies the first and second child safety locking members as a projection 21 and a latching block or tab 31, respectively, a wide variety of alternative locking mechanisms are likewise envisioned and available for use in place of projection 21 and latching tab 31. For example, the locking members may include a pin and detent or hole arrangement, a hook and eyelet arrangement, or any other locking mechanism known or foreseeable in the art so long as the mechanism cannot be easily unlatched and so long as the gasket 7 is positioned and located within the bottle cap 5 such that the first and second locking members cannot engage each other until gasket member 7 is removed therefrom.

It is also recognized and anticipated that although the present container has been described in relationship to an air freshener container, the present bottle, cap and gasket arrangement can be used on any child resistant container regardless of the end use of the container.

The various constructions described above and illustrated in the drawings are presented by way of example only and are not intended to limit the concepts and principles of the present invention. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present invention will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A container comprising:

a bottle having a first locking member associated therewith;

a bottle cap for selectively engaging said bottle, said bottle cap including a second locking member for selectively engaging said first locking member; and a gasket member separate and apart from said bottle and said bottle cap, said gasket member being engagable with said bottle cap prior to engaging said bottle cap with said bottle, said gasket member allowing said bottle and said bottle cap to partially engage each other but preventing said first locking member from engaging said second locking member;

said gasket member being removable from said bottle cap and, when removed, allowing the bottle cap to be fully engaged with the bottle and allowing the first and second locking members to engage each other.

2. The container of claim 1 wherein said bottle and said bottle cap include corresponding threads for engaging each other, and wherein said first locking member is associated with the threaded portion of said bottle and wherein said second locking member is associated with the threaded portion of said bottle cap.

3. The container of claim 1 wherein said first locking member is a projection and said second locking member is a latching block.

4. The container of claim 3 wherein said projection includes a tapered portion and a stop surface.

5. The container of claim 3 wherein said latching block includes an inclined surface.

6. The container of claim 1 wherein said gasket member includes a tab for removing the gasket member from within said bottle cap.

7. An air freshener container comprising:

a bottle for containing an air freshener material and having a neck portion, said neck portion including a first locking member;

a bottle cap for selective engaging the neck portion of said bottle, said bottle cap including a second locking member for selectively engaging said first locking member; and a removable gasket member separate and apart from said bottle and said bottle cap, said gasket member being engagable with said bottle cap prior to engaging said bottle cap with the neck portion of said bottle, said gasket member allowing said bottle cap to partially engage the neck portion of said bottle but not allowing said first and second locking members to engage each other;

said gasket member being removable from said bottle cap for allowing said first and second locking members to engage each other.

8. The air freshener container of claim 7 wherein said first locking member is a projection and the second locking member is a latching tab.

9. The air freshener container of claim 7 wherein said projection includes an inclined surface and a stop surface.

10. The air freshener container of claim 7 wherein the latching tab includes a tapered ramp.

11. The air freshener container of claim 7 wherein said gasket member includes a tab for removing the gasket member from within said bottle cap.

12. The air freshener container of claim 7 wherein said bottle cap includes at least one hole.

13. The air freshener container of claim 7 including a removable seal positioned over the neck portion of said bottle.

14. An air freshener container for holding odor-neutralizing beads comprising:

a bottle having a threaded neck portion and a projection;

a bottle cap having corresponding threads for selectively engaging the threaded neck portion of said bottle, said bottle cap including a latching tab for selectively engaging said projection and at least one opening;

a removable seal positioned over the neck portion of said bottle; and a removable gasket member positioned within said bottle cap for allowing said bottle cap to be partially threaded onto the threaded neck portion of said bottle but preventing further threaded engagement therebetween thereby preventing said latching tab from engaging said projection;

said gasket member being removable from said bottle cap for allowing further threaded engagement between said bottle cap and the neck portion of said bottle so as to allow said latching tab to engage said projection.

15. The air freshener container of claim 14 wherein said projection includes a tapered ramp and a stop surface.

16. The air freshener container of claim 14 wherein said latching tab includes an inclined surface.

17. The air freshener container of claim 14 wherein said gasket member includes a tab for grasping and removing the gasket member from within said bottle cap.

18. The air freshener container of claim 14 wherein said cap includes a plurality of openings.

* * * * *